US007682206B2

(12) United States Patent
Kainz

(10) Patent No.: US 7,682,206 B2
(45) Date of Patent: Mar. 23, 2010

(54) ELECTRICAL PRESSURE CONTACT

(75) Inventor: Andreas Kainz, Leingarten (DE)

(73) Assignee: ERA-Contact GmbH (DE)

( * ) Notice: Subject to any disclaimer, the term of this patent is extended or adjusted under 35 U.S.C. 154(b) by 87 days.

(21) Appl. No.: 11/632,241

(22) PCT Filed: Jul. 13, 2005

(86) PCT No.: PCT/EP2005/007638

§ 371 (c)(1),
(2), (4) Date: Jan. 28, 2008

(87) PCT Pub. No.: WO2006/005614

PCT Pub. Date: Jan. 19, 2006

(65) Prior Publication Data

US 2009/0004929 A1 Jan. 1, 2009

(30) Foreign Application Priority Data

Jul. 13, 2004 (DE) ..... 10 2004 033 864

(51) Int. Cl.
*H01R 13/24* (2006.01)

(52) U.S. Cl. ..... 439/824; 439/843; 439/700

(58) Field of Classification Search ..... 439/824, 439/843, 851, 700, 840, 816, 482
See application file for complete search history.

(56) References Cited

U.S. PATENT DOCUMENTS 3,805,216 A * 4/1974 Gaspar et al. ..... 439/332
5,681,187 A 10/1997 Fukushima et al.
6,159,056 A * 12/2000 Boyle ..... 439/700
6,254,439 B1 * 7/2001 Endo et al. ..... 439/843
6,447,343 B1 * 9/2002 Zhang et al. ..... 439/700
6,685,492 B2 * 2/2004 Winter et al. ..... 439/219
6,739,914 B2 5/2004 Strandfelt (Continued)

FOREIGN PATENT DOCUMENTS

DE 1 092 533 B 9/1959

(Continued)

OTHER PUBLICATIONS

ISR dated Nov. 9, 2005 for PCT/EP2005/007638.

(Continued)

*Primary Examiner*—Hae Moon Hyeon
(74) *Attorney, Agent, or Firm*—Harness, Dickey & Pierce, P.L.C.

(57) ABSTRACT

An electrical pressure contact device includes a sleeve with a first end and a second end. A contact head is slideably mounted in the sleeve and has a first end protruding from the sleeve and a second end located in the sleeve. A connecting piece has an inner portion connected to an inner wall of the sleeve and an outer portion protruding from the second end of the sleeve. An axially extending bore in a first piece located in the sleeve receives an elongated member of a second piece. A band has a plurality of inwardly arching lamellae and is located in the bore. The elongated member is inserted in the band so that the lamellae rub against the elongated member. A biasing element in the sleeve surrounds the elongated member and urges the contact head away from the sleeve.

14 Claims, 4 Drawing Sheets

U.S. PATENT DOCUMENTS

| | | | | |
|---|---|---|---|---|
| 6,773,312 | B2 | 8/2004 | Bauer et al. | |
| 7,291,033 | B2 * | 11/2007 | Hu | 439/347 |
| 7,387,548 | B2 * | 6/2008 | Takehara et al. | 439/843 |

FOREIGN PATENT DOCUMENTS

| | | | |
|---|---|---|---|
| DE | 20 26 386 | A | 5/1970 |
| DE | 697 00 120 | T2 | 2/1997 |
| DE | 199 83 759 | T1 | 11/1999 |
| EP | 0 435 408 | A | 7/1991 |
| EP | 0 838 878 | A | 4/1998 |
| EP | 1 102 359 | | 5/2001 |
| EP | 1 385 233 | A | 1/2004 |
| JP | 10-189087 | | 7/1998 |
| JP | 2002-231361 | | 8/2002 |
| JP | 2002-270 270 | A | 9/2002 |
| WO | WO 00/31828 | | 6/2000 |

OTHER PUBLICATIONS

IPER dated Oct. 10, 2006 for PCT/EP2005/007638.
International Preliminary Report on Patentability for PCT/EP2005/007638.

* cited by examiner

ELECTRICAL PRESSURE CONTACT

CROSS-REFERENCE TO RELATED APPLICATIONS

This application is a National Stage of International Application No. PCT/EP2005/007638, filed Jul. 13, 2005. This application claims the benefit of German Application DE 10 2004 033 864.7, filed Jul. 13, 2004. The disclosures of the above applications are incorporated herein by reference.

BACKGROUND OF THE INVENTION

1. Technical Field

The invention relates to an electrical pressure contact comprising a housing sleeve with an end facing the contact and an end facing away from the contact, a conductive contact head that is mounted in the housing sleeve so as to be movable in an axial direction, and which protrudes from the facing the contact end of the housing sleeve, a biasing element that is disposed within the housing sleeve, against whose biasing force the contact head is insertable in the housing sleeve, and a conductive connecting piece that is located at the away from the contact facing end of the housing sleeve for the attachment of an electrical lead.

2. Discussion

Electrical pressure contacts of the initially described kind serve, for example, for current or signal transfer between elements that are movable against one another. The contact head provided in the pressure contact provides, on the one hand, for a resilient mechanical contact with a counter contact that is movable relative to the housing sleeve. On the other hand, an electrical contact to an electrical lead that is fixed to the connecting piece is producible through the conductive contact head.

Electrical pressure contacts of the initially identified type are known from the prior art, which include attached cords on the contact head and the connecting piece. In doing so, the cords are typically twisted, such that they accommodate an insertion of the contact head in the housing sleeve, without kinking. Through this, damaging of the cords can be avoided to a certain degree. Nevertheless, with these pressure contacts, damage frequently arises as a result of a large number of contact stokes, in particular, breaking of the cords. Besides that, the manufacturing of such pressure contacts is comparably complex and expensive.

With respect to the prior art, reference is made to an electrical pressure contact, which is described in EP 1 289 072 A2. This pressure contact has an axially flexible electrical lead, which is clamped with its contact facing end in an axial bore that is formed in the away from the contact facing end of the contact head and is clamped with its away from the contact facing end in an axial bore that is formed in a contact facing end of the connecting piece. Thereby, the flexible electrical lead can be formed of cords or also of a compression spring, against whose spring force the contact head is insertable into the housing sleeve.

DE 39 38 706 C1 discloses an electrical pressure contact, which manages without cords. As shown in FIG. 6, with this pressure contact, the away from the contact facing, i.e., in a housing sleeve 1 inserted portion 2 of a contact head 3 is formed as a hollow cylinder. The wall of the hollow cylinder includes several longitudinal slits 4, whereby wall sectors are formed, which serve as resilient, electrically conductive contact tongues 5. The contact tongues 5 rubbingly lie against the inner surface of the current transferring housing sleeve 1, so that the current can flow over the contact tongues 5 to the housing sleeve 1 and from there to a connection piece 6.

With this pressure contact, contact grease is introduced between the contact tongues 5 and the inner surface of the housing sleeve 1. The contact grease serves to provide for a transfer resistance between the contact tongues 5 and the housing sleeve 1 that is as small as possible and that is constant over time. Thereby, however, the problem appears that, as a result of the contact strokes, the contact grease travels from the interior of the housing sleeve 1 outward, and therefore, the contact grease is no longer available or also, for example, is contaminated by dust particles, which adhere to the contact facing end of the contact head 3 and, with insertion, travels into the interior of the housing sleeve 1. Through this contamination, the contact grease gradually loses both its contact properties as well as its lubrication properties. The loss of the contact properties leads to an increase in the transfer resistance between the contact tongues 5 and the housing sleeve 1, the mechanical properties of the pressure contact degrades through the loss of the greasing properties, so that, for example, the contact head 3 can jam in the spring deflected condition in the housing sleeve 1.

In order to prohibit a deterioration of the contact grease, the end of the contact head 3 projecting out of the housing sleeve 1 is typically cleaned. The typically used cleaning means, however, functions to degrease and make the contact grease likewise gradually ineffective, if the cleaning means travels into the interior of the housing sleeve 1, as a result of the stroke movement of the contact head. In order to replace the now ineffective contact grease with new contact grease, the pressure contact must be dismantled, which is laborious, time intensive and costly. With respect to the prior art, reference is made to EP 0 838 878 A, EP 1 385 233 A, EP 1 102 359, and EP 0 435 408 A.

SUMMARY OF THE INVENTION

Based on this prior art, the object of the invention is to provide an electrical pressure contact of the above-identified type, which is simply constructed and includes a consistently good operational behavior over a long time with respect to its mechanical properties as well as its electrical properties.

The invention achieves this object through the given features in the characteristic part of claim 1.

With the pressure contact in accordance with the invention, the electrical contact between the contact head and the connecting piece is produced, such that the away from the contact facing portion of the contact head is accommodated to be axially movable in the contact facing axial bore that is formed in the connecting piece. The current or signal transfer occurs directly over the contact head and the connecting piece, without requiring a transfer through the housing sleeve. The axial bore of the connecting piece forms a separate contact space within housing sleeve. In this separate contact space, contact grease can be introduced, which holds the transfer resistance between the contact head and the connecting piece low and furthermore provides that the away from the contact facing portion is frictionlessly movable in the axial bore of the contact piece. Because the contact grease can be implemented in a separate contact space with the pressure contact in accordance with the invention, it is protected from contaminants like dust, which can appear in the interior of the housing sleeve as a result of the stroke movement. An exchange of the contact grease, which is associated with considerable assembly effort, is therefore also not necessary over a long duration. Also, the use of the degreasing cleaning means can be forgone, which, as described above, damages the effectiveness of the contact grease. The invention thus provides an electrical pressure contact, which is particularly well protected against environmental influences and requires practically no maintenance.

A conductive contact element sits in the bore and is coaxial thereto. The contact element rubbingly lies against the outer surface of the away from the contact facing portion of the contact head, which is axially movable, and produces the electrical contact between the contact head and the connecting piece.

Thus, with this embodiment, a contact element is located in the bore that is formed in the connecting piece. The away from the contact facing portion of the contact head is inserted into the contact element and contacts with this. Herewith, the away from the contact facing portion of the contact head, the bore that is formed in the contact piece, as well as the contact element sitting therein, form a particularly stable coaxial arrangement, which enables a simple assembly without large alignment effort. The contact element rubbingly lies against the outer surface of the away from the contact facing portion of the contact head that is movable in the contact element, so that a secure contacting is provided for. The current transfer occurs with an advantageously low transfer resistance from the contact head over the contact element directly, i.e., without a detour over the housing sleeve, to the connecting piece.

The contact element that sits fixed in the bore of the connecting piece provides, on the one hand; for a good mechanical guidance of the contact head that is inserted in the bore and, on the other hand, for a good electrical contact between the contact head and the connecting piece. Through this, a constant transfer resistance is provided for even after a high number of contact strokes. The pressure contact thus includes consistently good operational behavior over a long duration.

The contact element is a metallic, tubular formed element, in which the away from the contact facing section of the contact head is always at least partially inserted, and has several concave, inwardly arched contact lamellae that lie adjacent to one another in the peripheral direction and that run in the longitudinal direction, which are elastically biased against the outer surface of the part of the contact head inserted in the contact element. The elastically operative contact lamellae provide for both a good mechanical guidance as well as a secure contact of the contact head.

Preferably, the contact element has several slits that lie adjacent to one another in the peripheral direction and that run in the longitudinal direction. The contact lamellae are, in this embodiment, formed by the areas of the contact element that are formed between these slits. It is thus possible, to form the contact element especially simply and in particular as a single piece, which simplifies the construction of the pressure contact and thereby decreases the production cost.

Advantageously, an assembly slit is formed in the wall of the contact element, which penetrates the contact element over its entire length. Thereby, the contact element is with the decrease of the assembly slit so together pressable, that the diameter of the contact element decreases. This advantageous further development of the invention enables the contact element to be easily compressed upon the assembly of the pressure contact and insertable in the bore formed in the connecting piece. Once inserted in the bore, the contact element again expands as a result of its elasticity, and is thus held securely and stably in the bore. Through this, the assembly of pressure contact is simplified.

Preferably, the contact element is located in interference fit in the bore of the connecting piece. This also simplifies the construction of the pressure contact.

In a preferred embodiment of the invention, the bore of the connecting piece has a larger diameter part, a smaller diameter part and a radially inward standing shoulder between these two parts. Thereby, the contact element is located in the larger diameter part and lies with an end against the shoulder. This embodiment enables the contact element to be assembled in a particularly simple manner in the bore of the connecting piece. Because the contact element is located in the larger diameter part of the bore, the away from the contact facing end of the contact head can be inserted through the contact element through until in the smaller diameter part of the bore. This allows a particular compact construction of the pressure contact with good mechanical guidance and secure contacting of the contact head.

In the preceding detailed further development, the length of the contact element is preferably equal to the length of the larger diameter part of the bore, while the outer diameters of the two ends of the contact element are equal to the diameter of the larger diameter part of the bore. The contact thus fills out the larger diameter part of the bore in its entire length and is radially fixed over its two ends in this part of the bore. This also simplifies the construction of the contact head.

Preferably, the away from the contact facing, smaller diameter portion of the contact head is completely inserted into the bore, when the contact head is maximally inserted in the housing sleeve, while it is only inserted in the larger diameter part of the bore with its away from the contact facing end, when the contact head maximally protrudes from the contact facing end of the housing sleeve. In this manner, the away from the contact facing portion of the contact head is still more securely guided into the bore of the connecting piece. Thereby, the length of the away from the contact facing, smaller diameter portion of the contact head preferably corresponds to the length of the bore. The axial dimensions of the pressure contact can thusly be reduced.

The contact element preferably comprises silver plated brass. This material distinguishes itself on the one hand through good conductivity and on the other hand through mechanical durability. Also this contributes to a good mechanical guidance as well as to guarantee a secure contact of the contact head.

In another embodiment, it is provided that a connecting piece has an away from the contact facing, larger diameter portion, over which it is fixed to the inner wall of the housing sleeve, and has a contact facing, smaller diameter portion. It is provided that the contact head has a contact facing, larger diameter portion and the away from the contact facing portion with a smaller diameter. It is also provided that the biasing element is a coil spring, which surrounds the away from the contact facing portion of the contact head and the contact facing portion of the connecting piece. With this embodiment, a coil spring that forms the biasing element is located in the space, which is present in the housing sleeve about the meshing arrangement of contact head and connecting piece, i.e., the above identified contact space. Thus, the space that is available within the housing sleeve is optimally used. The electrical pressure contact is widely applicable. For example, it can be part of a train coupling.

BRIEF DESCRIPTION OF THE DRAWINGS

Further advantages and features of the solution in accordance with the invention are provided in the following description, which are detailed in conjunction the attached drawings and in hand with an exemplary embodiment are detailed. There is shown.

DESCRIPTION OF THE PREFERRED EMBODIMENTS

Figure 1:
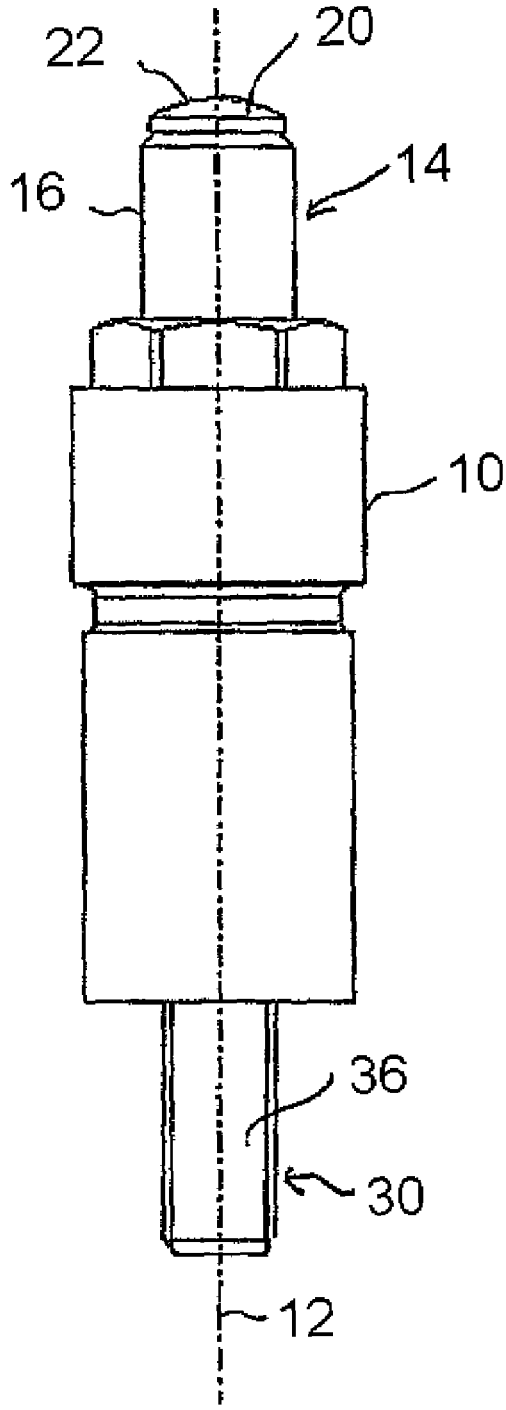
FIG. 1 is a side view of the electrical pressure contact in accordance with the invention.
Figure 2:
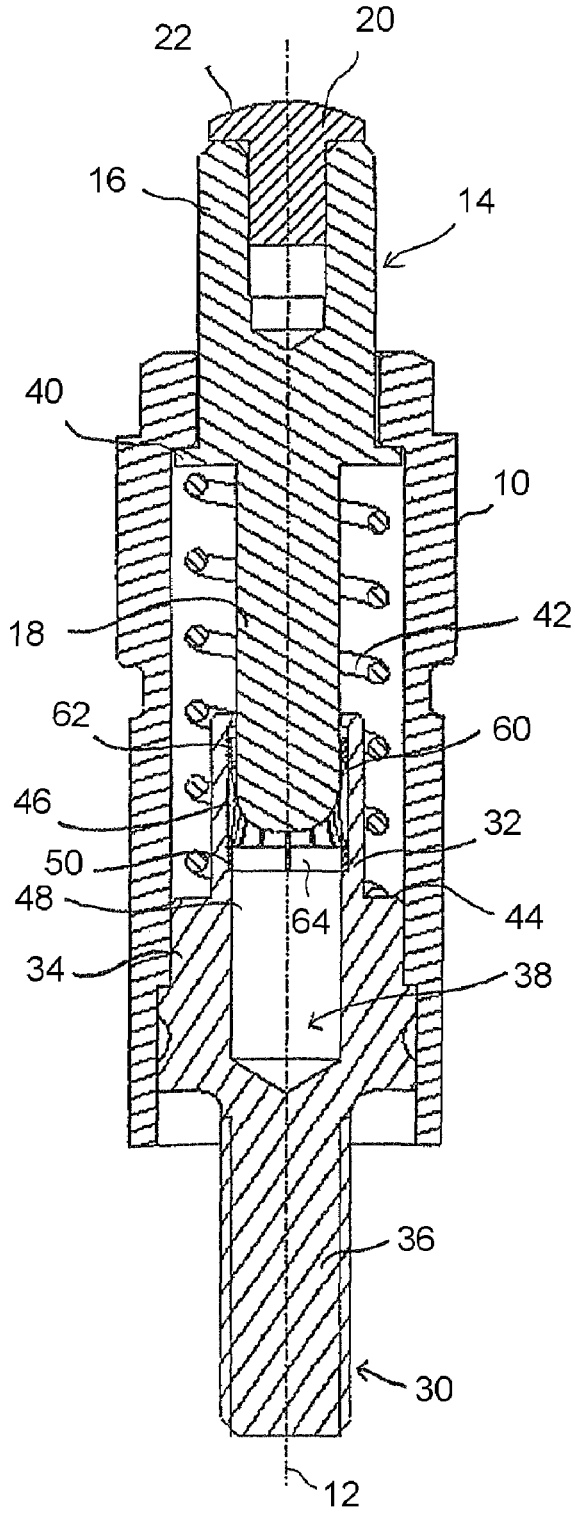
FIG. 2 is a longitudinal section through the electrical pressure contact.

FIGS. 1 through 5 Illustrate an exemplary embodiment of the electrical pressure contact in accordance with the invention with a housing sleeve 10, which has a contact facing end, the upper end in FIGS. 1 and 2, and an away from the contact facing end, the lower end in FIGS. 1 and 2. The housing sleeve axis is indicated with reference number 12.

A contact head 14 is axially movably arranged in the housing sleeve 10. The contact head 14 has a first end or contact facing portion 16, which, in the condition of the pressure contact illustrated in FIG. 2, protrudes from the contact facing end of the housing sleeve 10, and a second end or an away from the contact facing portion 18, which is located within the housing sleeve 10 forming an elongated member. The diameter of the contact facing portion 16 is larger than that of the away from the contact facing portion 18.

In the contact facing end of the portion 16 of the contact head 14 is inserted a contact rivet 20, for example, made of silver, which has a bulging contact surface 22 that faces the contact. The contact surface 22 is provided for contact with a counter contact that is not illustrated in FIGS. 1 and 2.

A connecting piece 30 is inserted in the away from the contact facing end of the housing sleeve 10, which connecting piece 30 has a collar or contact facing portion 32 and inner portion or an away from the contact facing portion 34 coupled thereto. The diameter of the portion 34 is larger than that of the portion 32. The connecting piece 30 is fixed over its larger diameter portion 34 to the inner surface of the housing sleeve 10, for example, press-fit. The connecting piece 30 further has an away from the contact facing end 36, which protrudes from the away from the contact facing end of housing sleeve 10. Unlike the contact head 14, the connecting piece 30 is immovably arranged in the housing sleeve 10.

A contact facing bore 38 is formed in the connecting piece 30, which is exposed to the counter contact not illustrated in the FIG. 2. In this exemplary embodiment, the bore 38 is formed as a blind hole. The away from the contact facing portion 18 of the contact head 14 is inserted into the blind hole 38, wherein it finds itself in the bore 38 only with its free end, in the condition of the away from the contact facing portion 18 illustrated in FIG. 2. The length of the away from the contact facing portion 18 of the contact head 14 and the length of the blind hole 38 are dimensioned such that the away from the contact facing portion 18 is completely received into the blind hole 38 when the counter contact inserts the contact head 14 into the housing sleeve 10. In the completely inserted condition, a shoulder 40 that is formed on the contact head 14 comes into contact with the contact facing end of the connecting piece 30. In this exemplary embodiment, the away from the contact facing portion 18 of the contact head 14 and the blind hole 38 have approximately the same length. This means that the blind hole 38 is completely filled essentially over its entire length by the away from the contact facing portion 18 with the contact head 14 completely inserted in the housing sleeve 10.

A coil spring 42 is located in the housing sleeve 10, which biases the contact head 14 in the contact direction. The coil spring 42 lies with its contact facing end against the flange or shoulder 40 formed on the contact head 14, while it lies against a shoulder 44, which is formed from the contact facing face surface of the larger diameter portion 34 of the connecting piece 30, with its away from the contact facing end. The contact head 14 is thus inserted in the housing sleeve 10 against the spring force of the coil spring 42 through the action of the counter contact.

The blind hole 38 has a contact facing part 46 and an away from the contact facing part 48. The diameter of the contact facing part 46 is somewhat larger than the diameter of the away from the contact facing part 48. The transition between the two parts 46 and 48 of the blind hole 38 is formed from a shoulder 50.

Figure 3:
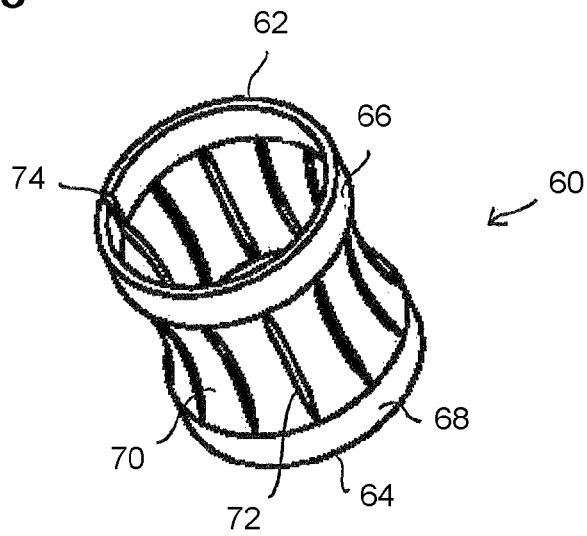
FIG. 3 is a perspective view of a contact element located in the electrical pressure contact.
Figure 4:
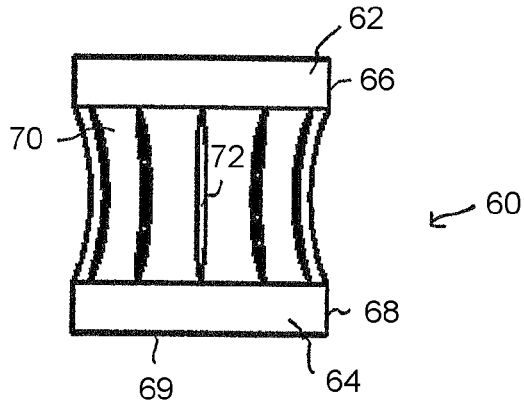
FIG. 4 is a further perspective view of the contact element.
Figure 5:
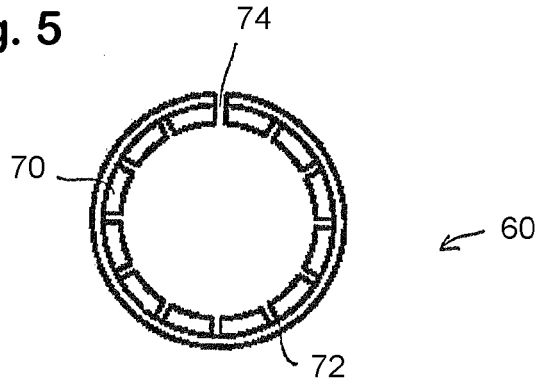
FIG. 5 is a plan view of the contact element.
Figure 6:
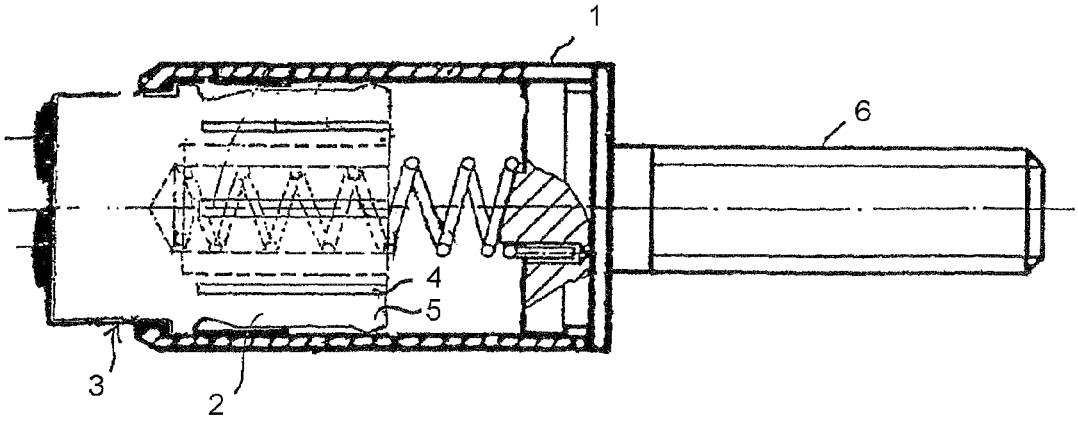
FIG. 6 is a longitudinal section through an electrical pressure contact that is known from the prior art.

In the larger diameter part 46 of the blind hole 38, sits a one-piece formed contact element 60, which is illustrated in more detail in FIGS. 3, 4 and 5. The contact element 60 is a band or ring-shaped element of metal, for example, silver plated brass. It has a contact facing end 62 and an away from the contact facing end 64, which have respective ring-shaped outer surfaces 66 and 68 that are straight in the longitudinal direction. With the outer surfaces 66 and 68, the contact element 60 lies against the inner wall of the larger diameter part 46 of the blind hole 38. Besides that, the away from the contact facing face surface, which is indicated with 69, of the end 64 the end of the contact element 60 lies against the shoulder 50, which is formed between the two parts 46 and 48 of the blind hole 38. The length of the contact element 60 corresponds to the length of the larger diameter part 46 of the blind hole 38. The outer diameters of the two ends 62 and 64 of the contact element 60 correspond to the diameter of the larger diameter part 46 of the blind hole 38. As a result of the above-identified dimensions of the contact element 60, the latter sits fixed in the larger diameter portion 46 of the blind hole 38.

The contact element 60 has several concave, inwardly arched contact lamellae 70 that lie adjacent to one another in the circumferential direction and that run in the longitudinal direction in its part lying between the two ends 62 and 64. The contact lamellae 70 are thereby formed through areas of the contact element 60, which lie between slits 72 formed in the walls of the contact element 60, which areas lie adjacent to one another in the circumferential direction of the contact element 60, and which run in the longitudinal direction parallel to the housing sleeve axis 12. The contact element 60 is formed such that its contact lamellae 70 are elastically resilient.

The contact element 60 further has an assembly slit 74 formed through its wall. This assembly slit 74 enables the contact element 60 to compress upon assembly such that the face surfaces of the assembly slit 74 that face one another come into contact with one another. Through this, the diameter of the contact element is decreased such that the latter enables itself to be inserted in the larger diameter part 46 of the blind hole 38. Once inserted into the part 46, the contact element broadens itself out again as a result of its elasticity, whereby the outer surface 66 and 68 come into contact with the inner walls of the larger diameter part 46 of the blind hole 38. The contact element 60 then sits securely in the larger diameter part 46 of the blind hole 38.

The contact lamellae 70 lie rubbingly against the outer surface of the away from the contact facing portion 18 of the contact head 14. Through this, a constant contact of the contact element 60 with the contact head 14 is provided for, when this is moved within the blind hole 38 by the action of the not illustrated counter contact. Besides that, the away from the contact facing portion 18 is mechanically led through the contact element 60 surrounding it. The elastic action of the contact element 60 is advantageous for the electrical contacting as well as also for the mechanical feeding of the contact head 14.

If the contact head 14 is inserted in the housing sleeve 10, thus the away form the contact facing end of the smaller diameter portion 18 of the contact head 14 commences through the contact element 60 into the smaller diameter part 48 of the blind hole 38. In this exemplary embodiment, the dimensions of the pressure contact are selected such that, in the condition illustrated in FIG. 2, in which the contact head 14 maximally protrudes from the contact facing end of the housing sleeve 10, the away from the contact facing portion 18 of the contact head 14 is almost completely received in the contact element 60. Through this, the contact surface between the contact head 14 and the contact element 60 is largely constant during the insertion of the contact head 14 in the housing sleeve 10. Consequently, the transfer resistance between the contact head 14 and the contact element 60 is practically constant over the entire length of the contact stroke.

The current transfer occurs from the not illustrated counter contact over the contact rivet 20, the contact head 14, the contact element 60 and the connecting piece 30 to a not illustrated electrical lead, which is secured to the away from the contact facing end 36 of the connecting piece 30. A current transfer through the housing sleeve 10 is accordingly not required.

A further important feature of the described pressure contact lies in that the bore 38 formed in the connecting piece 30 forms a separate contact space within the housing sleeve 10. This contact space is largely sealed from the space surrounding it within the housing sleeve 10. For this purpose, a sealing element can additionally be located, in the exemplary embodiment in accordance with FIG. 2, in the bore 38, which seals the contact space from the space surrounding it. In this contact space, an appropriate contact grease can be introduced in the area of the contact element 60. This contact grease is protected from environmental influences by its arrangement in the sealed contact space, for example, from dust, which appears in the interior of the housing sleeve, or from particles, which originate as a result of the contact strokes, e.g., through abrasion within the housing sleeve 10. Because the contact grease does not become contaminated in the contact space, and because of this also does not deteriorate, it must not as a rule be replaced after a high number of contact strokes. Accordingly, the pressure contact requires no special maintenance with regard to the contact grease used therein.

The electrical pressure contact in accordance with the invention is not limited to the preceding exemplary embodiment. Thus, for example, the contact element does not have to be formed as a single piece. It can also extend over the entire length of the bore that is provided in the connecting piece.

For example, the away from the contact facing portion 18 of the contact head 14 that is received in the bore 38 can also be formed as a hollow cylinder, as is described in DE 39 38 706 C1. In this case, resilient wall sectors are formed on the contact head, which lie against the interior surface of the bore 38.

The invention claimed is:

1. An electrical pressure contact, comprising:

a housing sleeve with a contact facing end and an away from the contact facing end;

a conductive contact head, which is mounted in the housing sleeve to be axially movable and which protrudes from the contact facing end of the housing sleeve;

a biasing element located in the housing sleeve for biasing the contact head; and a conductive connecting piece that is located at the away from the contact facing end of the housing sleeve for the attachment of an electrical lead wherein the connecting piece has a contact facing axial bore within the housing sleeve, the contact head being arranged to be axially moveable in the axial bore for the production of the electrical contact between the contact head and the connecting piece;

a conductive contact element sits within the bore and is coaxial thereto, which contact element rubbingly lies against an outer surface of the axially movable away from the contact facing portion of the contact head in the bore and produces the electrical contact between the contact head and the connecting piece, and the contact element is a metallic, tube-shaped element in which the away from the contact facing portion of the contact head is always at least partially received and which has several concave inwardly arching contact lamellae that lie adjacent to one another in the peripheral direction and that run in the longitudinal direction, which are elastically biased on the outer surface of the portion of the contact head that is received in the contact element; and wherein the connecting piece has an away from the contact facing, larger diameter portion that is fixed to the interior wall of the housing sleeve, and the connecting piece having a contact facing, smaller diameter portion, wherein the contact head has a contact facing, larger diameter portion and an away from the contact facing portion with a smaller diameter, and wherein the biasing element is a coil spring which surrounds the away from the contact facing portion of the contact head and the contact facing portion of the connecting piece.

2. The electrical pressure contact in accordance with claim 1, wherein several slits are formed in the wall of the contact element, which lie adjacent to one another in the peripheral direction and run in the longitudinal direction, and in that the contact lamellae are formed by the areas of the contact element formed between these slits.

3. The electrical pressure contact in accordance with claim 1, wherein an assembly slit is formed in the wall of the contact element, which penetrates the contact element over the entire length of the contact element, and in that the contact element is so compressible under decreasing of the width of the assembly slit such that the diameter of the contact element decreases.

4. The electrical pressure contact in accordance with claim 1, wherein the contact element is press-fit within the bore of the connecting piece.

5. The electrical pressure contact in accordance with claim 1, wherein the bore of the connecting piece has a contact facing, larger diameter part, an away from the contact facing, smaller diameter part and a radially inward standing shoulder between the larger diameter part and the smaller diameter part, and in that the contact element is located in the larger diameter part and lies with an end against the shoulder.

6. The electrical pressure contact in accordance with claim 5, wherein the length of the contact element is equal to the length of the larger diameter part of the bore, and in that the outer diameters of the two ends of the contact element are equal to the diameter of the larger diameter part of the bore.

7. The electrical pressure contact in accordance with claim 6, wherein the two ends of the contact element each have a ring-shaped exterior surface that runs straight in the longitudinal direction, and which lies against the interior wall of the larger diameter part of the bore.

8. The electrical pressure contact in accordance with claim 5, wherein the away from the contact facing, smaller diameter portion of the contact head is completely received in the bore when the contact head is maximally inserted into the housing sleeve, while the smaller diameter portion of the contact head is only received in the larger diameter part of the bore when the contact head maximally protrudes from the contact facing end of the housing sleeve.

9. The electrical pressure contact in accordance with claim 8, wherein the length of the away from the contact facing, smaller diameter portion of the contact head corresponds to the length of the bore.

10. The electrical pressure contact in accordance with claim 1, wherein the contact element comprises silverplated brass.

11. An electrical pressure contact device comprising:

a sleeve with a first end and a second end;

a contact head element slideably mounted in the sleeve, said contact head having a first end protruding from the first end of the sleeve and a second end located in the sleeve;

a connecting piece element having an inner portion connected to an inner wall of the sleeve and an outer portion protruding from the second end of the sleeve;

one of the elements having an axially extending bore therein, another of the elements having an elongated member, said bore receiving the elongated member;

a band having a plurality of inwardly arching lamellae, said band being located in the bore, said elongated member being inserted in the band so that the lamellae rub against the elongated member; and a biasing element in the sleeve and surrounding the bore and the elongated member for urging the contact head away from the sleeve.

12. The device of claim 11 wherein the one element is the connecting piece and the bore is in the inner portion of the connecting piece and the wherein the another element is the contact head and the elongated member is the second end of the contact head.

13. The device of claim 12 wherein the inner portion of the connecting piece has an annular collar through which the bore extends, the bore having a first section of a given diameter and a second section of a larger diameter, said sections being connected by a radially inwardly extending shoulder, said band being located in the second section.

14. The device of claim 13 wherein an inner portion of the contact head in the sleeve has a flange portion, and wherein said biasing element is a coil spring having one end adjacent the flange portion of the contact head and an opposite end of the spring resting on the inner portion of the connecting piece and surrounding the collar thereof.

* * * * *